US009284702B2

(12) United States Patent
Lee

(10) Patent No.: US 9,284,702 B2
(45) Date of Patent: Mar. 15, 2016

(54) SNOW MELTER INCLUDING ANTI FREEZING SNOW THROWER FROM HOT AIR SPRAY

(76) Inventor: Jang Yong Lee, Cheonan (KR)

( * ) Notice: Subject to any disclaimer, the term of this patent is extended or adjusted under 35 U.S.C. 154(b) by 0 days.

(21) Appl. No.: 13/811,260

(22) PCT Filed: Dec. 28, 2011

(86) PCT No.: PCT/KR2011/010239

§ 371 (c)(1),
(2), (4) Date: Apr. 17, 2013

(87) PCT Pub. No.: WO2013/027901

PCT Pub. Date: Feb. 28, 2013

(65) Prior Publication Data

US 2013/0219756 A1 Aug. 29, 2013

(30) Foreign Application Priority Data

Aug. 22, 2011 (KR) ..... 10-2011-0083233

(51) Int. Cl.
*E01H 5/10* (2006.01)
*E01H 5/07* (2006.01)

(52) U.S. Cl.
CPC ..... *E01H 5/104* (2013.01); *E01H 5/076* (2013.01)

(58) Field of Classification Search
USPC ..... 37/196, 199, 227–230; 126/343.5 R
See application file for complete search history.

(56) References Cited

U.S. PATENT DOCUMENTS 993,400 A * 5/1911 Petersen ..... 37/228
1,462,527 A * 7/1923 Marks ..... 37/228
1,602,476 A * 10/1926 Ballard ..... 126/343.5 R
1,642,895 A * 9/1927 Robinson ..... 37/228
1,742,968 A * 1/1930 Polak ..... 37/228
3,011,493 A * 12/1961 Zieba ..... 126/343.5 R
3,066,428 A * 12/1962 Raiti ..... 37/228
3,106,792 A * 10/1963 Park ..... 37/227
3,149,428 A * 9/1964 Hukill ..... 37/226
3,155,089 A * 11/1964 Hoyt ..... 126/343.5 R
3,261,965 A * 7/1966 Kerznar et al. ..... 219/420
3,304,632 A * 2/1967 Kotlar et al. ..... 37/228
3,309,798 A * 3/1967 Devlin et al. ..... 37/228
3,484,961 A * 12/1969 Coslowsky ..... 37/227
3,766,586 A * 10/1973 Krickovich ..... 15/83

(Continued)

FOREIGN PATENT DOCUMENTS

JP 09-158145 A 6/1997
JP 10-152816 A 6/1998
KR 10-2004-0011785 A 2/2004

*Primary Examiner* — Matthew D Troutman
(74) *Attorney, Agent, or Firm* — Patent Office of Dr. Chung Park

(57) ABSTRACT

A snow melter for spraying hot air and preventing a snow thrower from being frozen. The snow melter includes: a snowblower; a transfer pipe which includes a snow thrower and a hot air receiving chamber, wherein the snow thrower is formed in the form of a stove pipe and is connected to the snowblower, and wherein the hot air receiving chamber is located outside the snow thrower and receives hot air introduced from the outside; a melting tank which includes a receiver and a melter, wherein the receiver receives the snow transferred through the snow thrower, and wherein the melter is connected to the receiver and melts the snow accumulated in the receiver by using high temperature hot air; and an hot air induction unit that collects the hot air generated by the melter and transfers the high temperature hot air to the transfer pipe.

6 Claims, 9 Drawing Sheets

(56) References Cited

U.S. PATENT DOCUMENTS

| | | | | |
|---|---|---|---|---|
| 3,866,340 | A * | 2/1975 | Krickovich | 37/228 |
| 4,071,966 | A | 2/1978 | Cohen | |
| 4,353,176 | A * | 10/1982 | Hess | 37/228 |
| 5,867,926 | A * | 2/1999 | Schmitt | 37/227 |
| 6,305,105 | B1 * | 10/2001 | Lowman | 37/228 |
| 6,904,708 | B2 * | 6/2005 | Rogers | 37/228 |
| 8,640,687 | B2 * | 2/2014 | Tucker | 126/343.5 R |
| 2009/0217554 | A1 * | 9/2009 | Tucker | 37/228 |

* cited by examiner

SNOW MELTER INCLUDING ANTI FREEZING SNOW THROWER FROM HOT AIR SPRAY

CROSS-REFERENCE TO PRIOR APPLICATIONS

This application is a national Stage Patent Application of PCT International Patent Application No. PCT/KR2011/010239, filed on Dec. 28, 2011 under 35 U.S.C. §371, which claims priority of Korean Patent Application No. 10-2011-0083233, filed on Aug. 22, 2011, which are all hereby incorporated by reference in their entirety.

TECHNICAL FIELD

The present invention relates to a snow melter which collects snow accumulated on a street and a shoulder in winter into a melting tank mounted in a vehicle and immediately melts the snow, and more particularly to a snow melter which sprays high temperature hot air generated in a melting tank and prevents snow in a snow thrower from being frozen, for the purpose of overcoming a problem that snow inhaled at a high pressure is accumulated and frozen in a snow thrower.

BACKGROUND ART

In general, two methods for removing snow accumulated on a road in winter are as follows. One is to spray a deicing agent or chloride solution on the road while driving on the road after loading a CaCl2 sand spreader and a chloride solution spreader and the like in a loading space of a vehicle. The other is to equip the front of the vehicle with a snowplow, and then to push out the accumulated snow and pressed snow to roadsides while driving on the road.

Another method other than the snow removal operation using the spreader and snowplow is to forcedly inhale a relatively large amount of snow by using a snowblower and then to throw the snow to the roadside.

The snowblower not only cuts down a large amount of snow but also forcedly inhale the cut snow through a strong inhaling force and then to throw the snow to the roadside. Therefore, the snowblower is able to effectively remove a great deal of accumulated snowfall that cannot be removed by using the spreader or snowplow.

However, unlike an outer road or a general road, a city road side is generally narrow, and the thrown to the roadside by the snowblower is accumulated on the roadside as it is. After a part of the accumulated snow is melted in the daytime in which the temperature rises and then is introduced into the road, the snow is frozen in the evening in which the temperature falls and freezes the road again.

Most snow remaining on the roadside without being melted looks ugly in the road and particularly may be expected to be an obstacle threatening a driver at night. The melted snow with the lapse of much time is introduced into a dry road, and thus pollutes the road and driving vehicles.

To overcome the aforementioned problems, in the past, a receiver and a melter are mounted on a vehicle, and then the snow inhaled from the snowblower is melted at a high temperature and is discharged in the form of melted liquid.

One example of a conventional snow melter will be described as follows with reference to FIGS. 1 and 2.

The conventional snow melter mainly includes a snowblower 2, a transfer pipe 3, a receiver 4 and a melter 5. The snowblower 2 inhales accumulated snow at a high pressure. The transfer pipe 3 transfers the snow inhaled from the snowblower 2. The receiver 4 receives the snow transferred from the transfer pipe 3. The melter 5 melts the received snow by using high temperature water vapor.

The melter 5 includes a combustion furnace 20, an air blower 10, a boiling chamber 30 and a spray jacket 40. The combustion furnace 20 generates high temperature combustion gas by using a burner. The air blower 10 supplies outside air to the combustion furnace 20 and provides a blowing force to the combustion gas. The boiling chamber 30 has one end which is integrally connected and installed to the combustion furnace 20 and has the other end which is located within the receiver 4. The boiling chamber 30 also includes a bottom plate 32 airtightly installed in the lower portion of the boiling chamber 30 and includes a plurality of outlets 34 formed horizontally along the outer circumference of the lower portion of the boiling chamber 30. The spray jacket 40 is formed to surround the boiling chamber 30 and melts the snow by discharging high temperature water vapor discharged through the outlet 34 to a water vapor outlet 42.

The snow inhaled from the snowblower 2 is thrown to the receiver 4 through the transfer pipe 3. Here, the thrown snow is first melted through the water vapor outlet 42 formed in the spray jacket 40 and then the melted snow is accumulated in the receiver 4 and is subsequently melted.

The configuration of the combustion furnace 20, the boiling chamber 30 and the spray jacket 40 will be described in more detail as follows with reference to FIG. 2.

High temperature gas generated in the combustion furnace 20 moves by the air blower 10 to the boiling chamber 30 connected to the combustion furnace 20. The boiling chamber 30 is located within the receiver 4 and is configured to melt the snow accumulated in the receiver 4 and boil the melted liquid by using the high temperature gas from the combustion furnace 20.

A large amount of water vapor can be rapidly generated in the boiling chamber 30 through the spray jacket 40 which is placed to surround the boiling chamber 30. The spray jacket 40 causes the generated water vapor to be discharged through the water vapor outlet 42 formed in the upper portion thereof.

Here, the water vapor outlet 42 is placed along a direction in which the snow is dropped from the transfer pipe 3, so that the water vapor discharged from the water vapor outlet 42 is sprayed onto the dropped snow. Accordingly, it is possible to more effectively melt the accumulated snow.

As such, since the conventional snow melter configured as such melts and discharges the accumulated snow by using the melter 5, the accumulated snow can be more effectively melted and removed. However, a problem has occurred in the transfer pipe 3 transferring the snow inhaled from the snowblower 2 to the receiver 4.

In other words, the snow transferred at a high pressure through the snowblower 2 is absorbed on the inner wall of the transfer pipe 3, and the absorbed snow is frozen. As a result, the transfer pipe 3 is blocked.

DISCLOSURE

Technical Problem

The objective of the present invention is to overcome the problems of a conventional snow melter. Unlike the conventional snow melter, a snow melter of the present invention further includes a hot air induction unit and transfers hot air generated by a melting tank to the transfer pipe, and thus prevents a transfer pipe from being frozen. The snow melter of the present invention forms a hot air path functioning as an air cushion within the transfer pipe, and thus prevents the snow transferred at a high pressure from being absorbed within the transfer pipe. As a result, it is possible to more effectively remove the accumulated snow.

Technical Solution

One aspect of this invention includes a snowblower which inhales accumulated snow, a transfer pipe which transfers the snow inhaled from the snowblower, a melting tank which receives the snow transferred from the transfer pipe and melts the snow by using high temperature gas, and an hot air induction unit which is located on the melting tank and transfers hot air generated by the melting tank to the transfer pipe, and thus prevents the transfer pipe from being frozen.

The transfer pipe includes a snow thrower and a hot air receiving chamber. The snow thrower transfers the snow inhaled from the snowblower. The hot air receiving chamber is located outside the snow thrower and receives and discharges the hot air transferred from the hot air induction unit.

The melting tank includes a receiver and a melter. The receiver receives the snow transferred through the transfer pipe. The melter is connected to the receiver and melts the snow accumulated in the receiver by using high temperature hot air.

The hot air induction unit includes a hot air guide and a hot air induction tube. The hot air guide is located on the melter and transfers outward the hot air through a nozzle formed therein. The hot air induction tube is connected to the nozzle and transfers the hot air generated by the melter to the hot air receiving chamber.

The hot air induction unit configured as such transfers the high temperature hot air generated by the melter to the transfer pipe and thus prevents the transfer pipe from being frozen.

The hot air receiving chamber is located to surround a portion of the outside of the snow thrower and is separated from the snow thrower by a separating member. A portion of the separating member is opened not to completely seal the hot air receiving chamber An air cushion is formed within the snow thrower by a flow of the hot air introduced into the hot air receiving chamber to an outlet formed on the snow thrower.

The separating member is made of a material having a low specific heat and a high thermal conductivity, so that the snow thrower is effectively prevented from being frozen. The hot air receiving chamber is provided at a plurality of locations of the transfer pipe instead of a particular location the transfer pipe.

Advantageous Effects

The present invention for overcoming the aforementioned problems has the following advantageous effects.

First, the hot air induction unit induces the hot air generated in the melter to the transfer pipe. Accordingly, unlike the conventional snow melter, there is an effect of preventing the snow inhaled at a high pressure from freezing the transfer pipe.

Secondly, the hot air receiving chamber is provided in the transfer pipe and surrounds a portion of the outside of the snow thrower. The separating member is provided which separates the hot air receiving chamber by a double jacket structure. A portion of the separating member is opened and the hot air moving through the hot air receiving chamber is discharged to the outside through the inside of the snow thrower, so that the hot air forms the air cushion within the snow thrower.

Through the air cushion formed in the above-described method, there is an effect of preventing the snow moving within the snow thrower from being absorbed within the snow thrower.

Thirdly, since the separating member is made of a material having a low specific heat and a high thermal conductivity, the heat of the moving hot air can be effectively used.

MODE FOR INVENTION

An embodiment of a snow melter according to the present invention, which sprays hot air and prevents a snow thrower from being frozen, will be described with reference to the accompanying drawings.

Here, this is not intended to limit the present invention to a particular mode but is provided for a better understanding of the present invention through the embodiment.

A configuration according to an embodiment of the present invention will be described as follows with reference to FIGS. 3 to 5.

Figure 1:
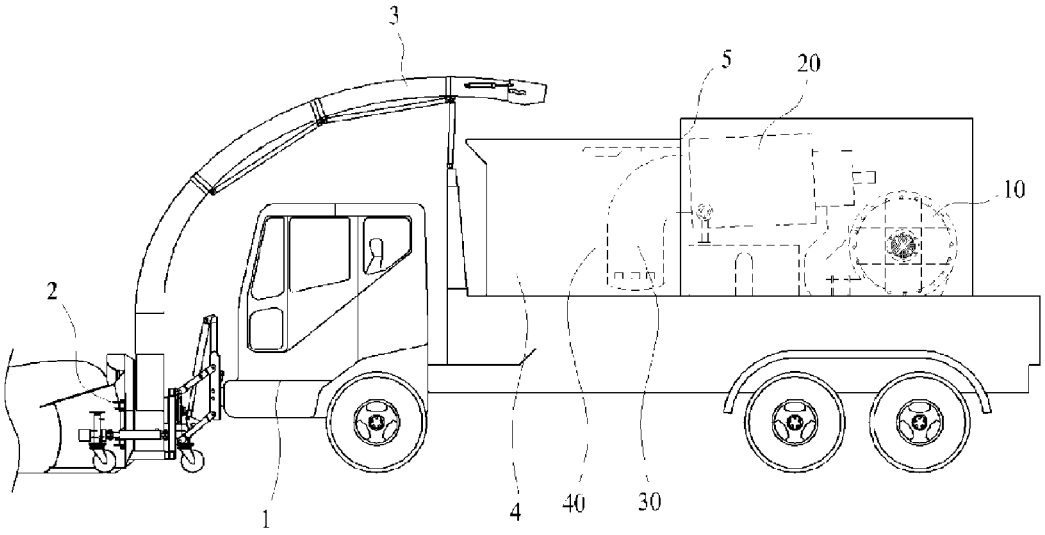
FIG. 1 PRIOR ART
FIG. 1 is a side view schematically showing a conventional snow melter.
Figure 2:
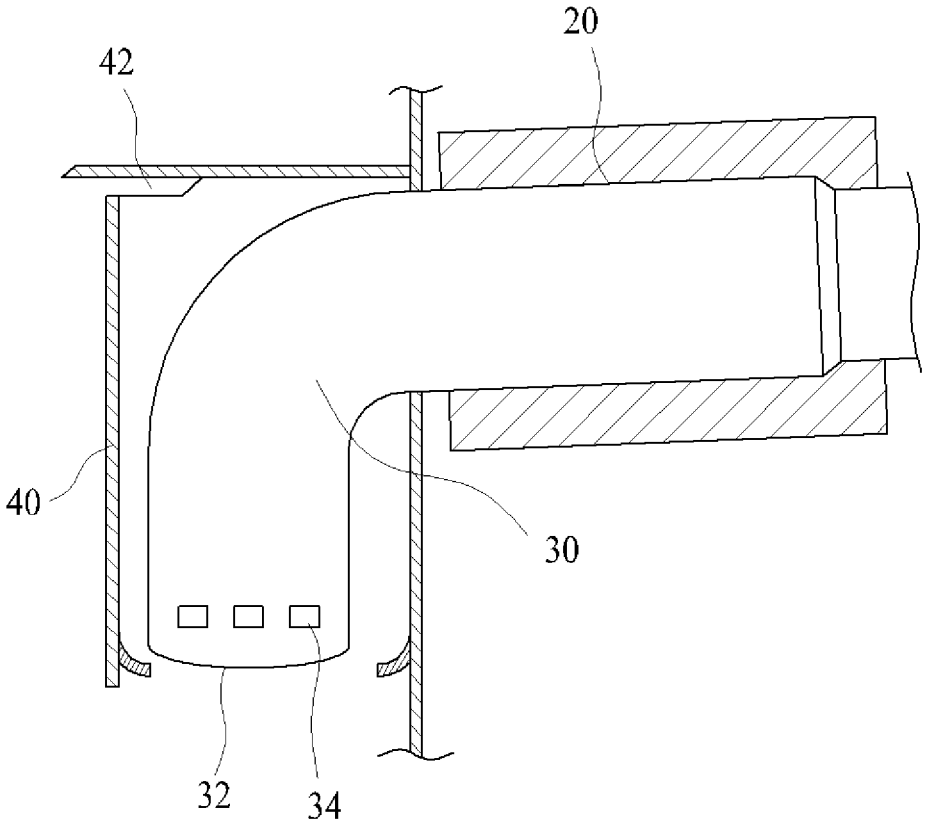
FIG. 2 PRIOR ART
FIG. 2 is a cross sectional view showing a configuration of a combustion furnace, a boiling chamber and a spray jacket of FIG. 1.
Figure 3:
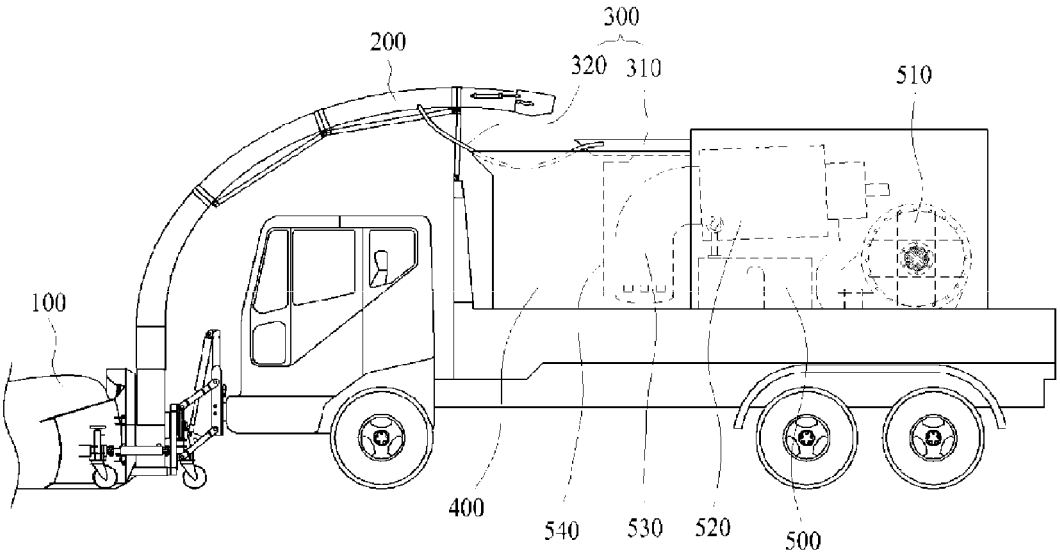
FIG. 3 is a side view schematically showing a configuration according to an embodiment of the present invention.

FIG. 3 is a side view schematically showing a configuration according to an embodiment of the present invention. FIG. 4 is a side view showing a configuration of a hot air induction unit. FIG. 5 is a plan view showing the configuration of the hot air induction.

A snow melter according to an embodiment of the present invention includes a snowblower 100, a transfer pipe 200, a melting tank and a hot air induction unit 300.

The snowblower 100 is located in a proceeding direction of a vehicle and inhales accumulated snow at a high pressure.

Figure 6:
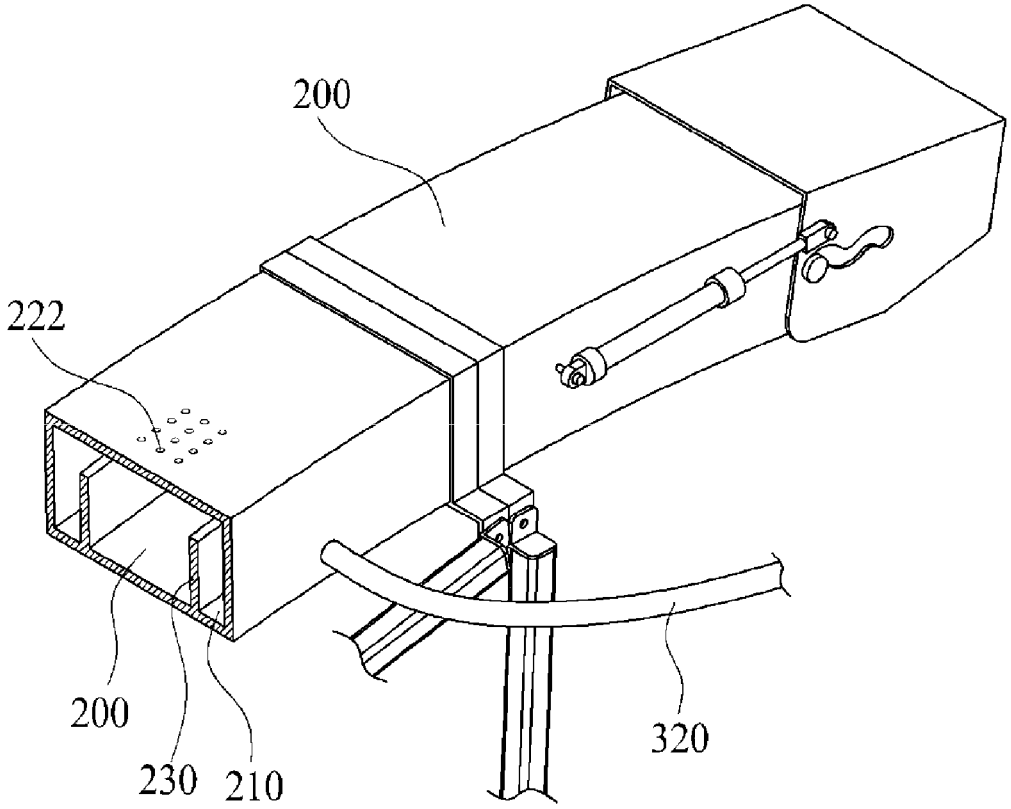
FIG. 6 is a sectional perspective view showing a configuration of a transfer pipe of FIG. 4.

The transfer pipe 200 includes a snow thrower 220 (see FIG. 6) and a hot air receiving chamber 210 (see FIG. 6). The snow thrower 220 is formed in the form of a stove pipe and is connected to the snowblower 100, and then transfers the snow inhaled from the snowblower 100. The hot air receiving chamber 210 is located to surround a portion of the outside of the snow thrower 220 and receives hot air introduced from the outside.

The hot air receiving chamber 210 transfers heat therearound by receiving internally and emitting the hot air sprayed from the outside, and then prevents itself from being frozen.

The melting tank includes a receiver 400 and a melter 500. The receiver 400 receives the snow transferred through the snow thrower 220. The melter 500 is connected to the receiver 400 and melts the snow accumulated in the receiver 400 by using the high temperature hot air.

The melter 500 includes a combustion furnace 520, an air blower 510, a boiling chamber 530 and a hot air collection jacket 540. The combustion furnace 520 generates high temperature combustion gas by using a burner (not shown) provided therewithin. The air blower 510 is connected to the combustion furnace 20 and provides a blowing force to the combustion gas. The boiling chamber 530 has one end which is connected to the combustion furnace 520 and has the other end which is located within the receiver 400. The boiling chamber 530 induces the high temperature combustion gas transferred by the blowing force to the inside of the receiver 400 and boils melted liquid introduced through an open lower portion. The hot air collection jacket 540 is located to surround the boiling chamber 530 and collects the hot air generated by the boiling chamber 530 to an open upper portion thereof.

In the melter 500 configured as such, the high temperature combustion gas generated by the burner moves to the boiling chamber 530 by the air blower 510. Then, the snow accumulated in the receiver 400 is melted in the boiling chamber 530 by the high temperature combustion gas.

High temperature water vapor is generated during the process of melting the accumulated snow through the boiling chamber 530.

Also, the hot air collection jacket 540 located to surround the boiling chamber 530 allows the boiling chamber 530 to intensively boil the snow melted therearound. Then, the hot air collection jacket 540 collects the water vapor generated in this manner and transfers the water vapor to the upper portion thereof.

The hot air induction unit 300 includes a hot air guide 310 and a hot air induction tube 320. The hot air guide 310 is located on the boiling chamber 530 and transfers outward the hot air generated by the boiling chamber 530 through a nozzle 312 formed therein. The hot air induction tube 320 is connected to the hot air guide 310 and transfers the hot air to the hot air receiving chamber 210.

The hot air collection jacket 540 includes an auxiliary nozzle 542 which is formed in the direction of the path of the snow thrown through the transfer pipe 200. The auxiliary nozzle 542 sprays the hot air onto the snow which is thrown, so that the accumulated snow is effectively melted.

Further, the hot air guide 310 located on the hot air collection jacket 540 transfers a portion of the hot air, which is transferred within the hot air collection jacket 540, to the hot air induction tube 320 through the nozzle 312.

The hot air transferred through the hot air induction tube 320 is transferred to the transfer pipe 200 and prevents the transfer pipe 200 from being frozen.

The configuration of the hot air induction unit 300 will be described in more detail with reference to FIG. 5. A plurality of the hot air induction tubes 320 may be provided which connect the hot air guide 310 with hot air receiving chamber 210.

The hot air is uniformly transferred to the hot air receiving chamber 210 through a plurality of the hot air induction tubes 320, so that the transfer pipe 200 can be effectively prevented from being frozen.

The hot air induction tube 320 is connected to plural sides instead of one side of the hot air receiving chamber 210, thereby transferring the hot air to the corner of the hot air receiving chamber 210.

Though the embodiment shows that a first hot air induction tube 321 and a second hot air induction tube 322 of the hot air induction tube 320 are connected to both sides of the transfer pipe 200, this is just intended to help a better understanding of the embodiment and is not intended to limit to a particular mode.

The hot air induction unit 300 configured as such allows the hot air transferred through the hot air collection jacket 540 to be transferred separately into the first hot air induction tube 321 and the second hot air induction tube 322, both of which are connected to the hot air guide 310.

Then, the hot air is transferred to the hot air receiving chamber 210. Accordingly, heat is uniformly transferred around the hot air receiving chamber 210.

Figure 7:
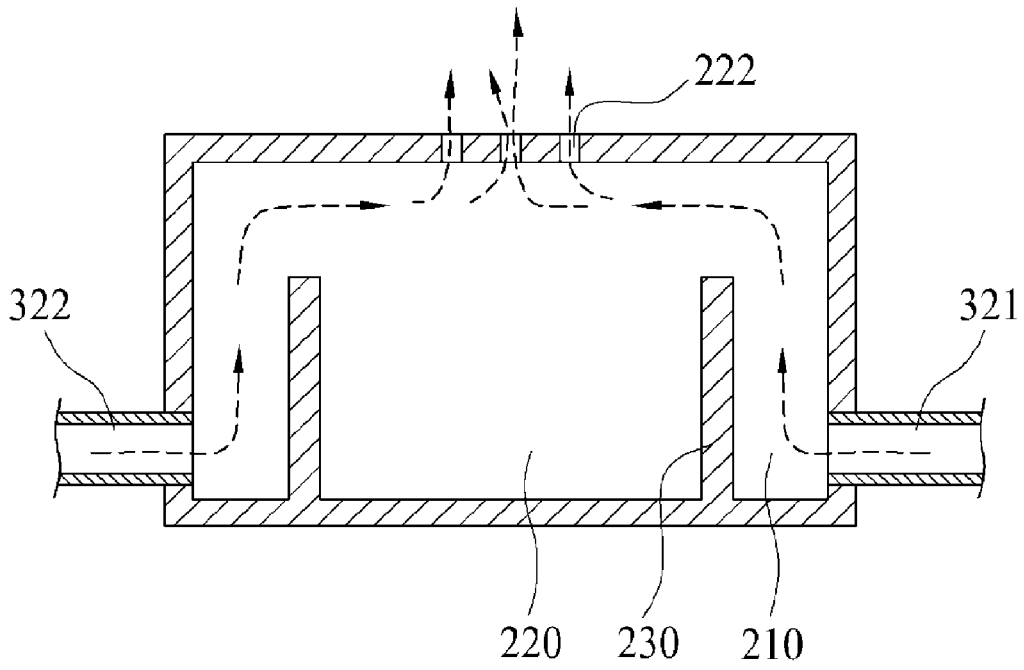
FIG. 7 is a cross sectional view showing the configuration of the transfer pipe of FIG. 6.

Next, the transfer pipe 200 will be described as follow with reference to FIGS. 6 and 7.

FIG. 6 is a sectional perspective view showing a configuration of the transfer pipe 200. FIG. 7 is a cross sectional view showing the configuration of the transfer pipe 200.

The inside of the transfer pipe 200 includes a separating member 230 which separates the snow thrower 220 and the hot air receiving chamber 210. A portion of the upper portion separating member 230 is opened not to completely seal the hot air receiving chamber 210.

Since the hot air receiving chamber 210 is not completely sealed, the hot air transferred from the hot air induction tube 320 is transferred to the inside of the snow thrower 220.

An outlet 222 is formed on the snow thrower 220. The hot air introduced through the first hot air induction tube 321 and the second hot air induction tube 322, both of which are connected to both sides of the hot air receiving chamber 210, is discharged, so that the hot air which is discharged forms an air cushion on the inner surface of the snow thrower 220 including the outlet 222 formed therein.

Here, the hot air induction tube 320 is separated into the first hot air induction tube 321 and the second hot air induction tube 322, so that the hot air can be uniformly transferred to the inside of the hot air receiving chamber 210. Also, the air cushion is easily formed inside the snow thrower 220 by the moving hot air.

Through such a configuration, the air cushion formed inside the transfer pipe 200 is able to prevent the moving snow from being absorbed and frozen within the transfer pipe 200.

The high temperature of the hot air received in the hot air receiving chamber 210 increases the ambient temperature of the hot air receiving chamber 210. Accordingly, the transfer pipe 200 is prevented from being frozen.

Next, the separating member 230 is composed of a material having a low specific heat and a high thermal conductivity. Thus, the snow thrower 220 is prevented from being frozen.

The low specific heat of the separating member prevents that the temperature of the snow thrower is decreased by external cold air and the snow being transferred within the transfer pipe 200.

Next, a configuration of a plurality of the hot air receiving chambers 210 which are located in the transfer pipe 200 will be described as follows with reference to FIGS. 8 and 9.

Figure 4:
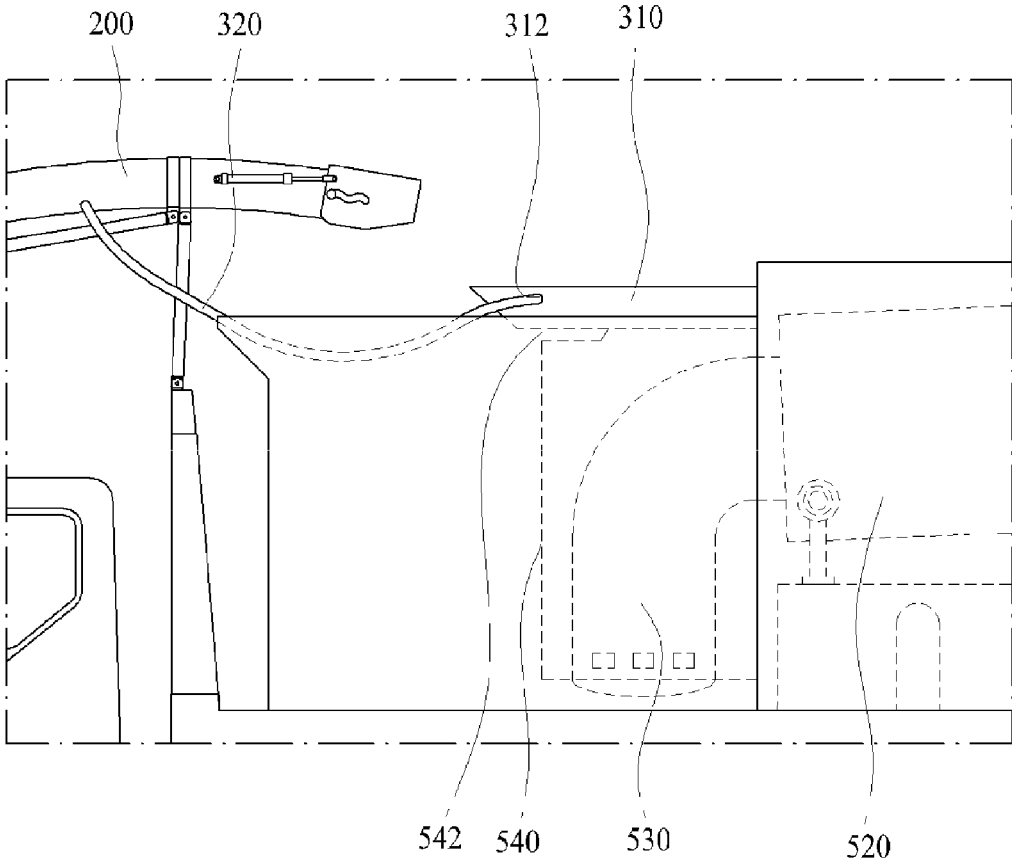
FIG. 4 is a side view showing a configuration of a hot air induction unit of FIG. 3.
Figure 5:
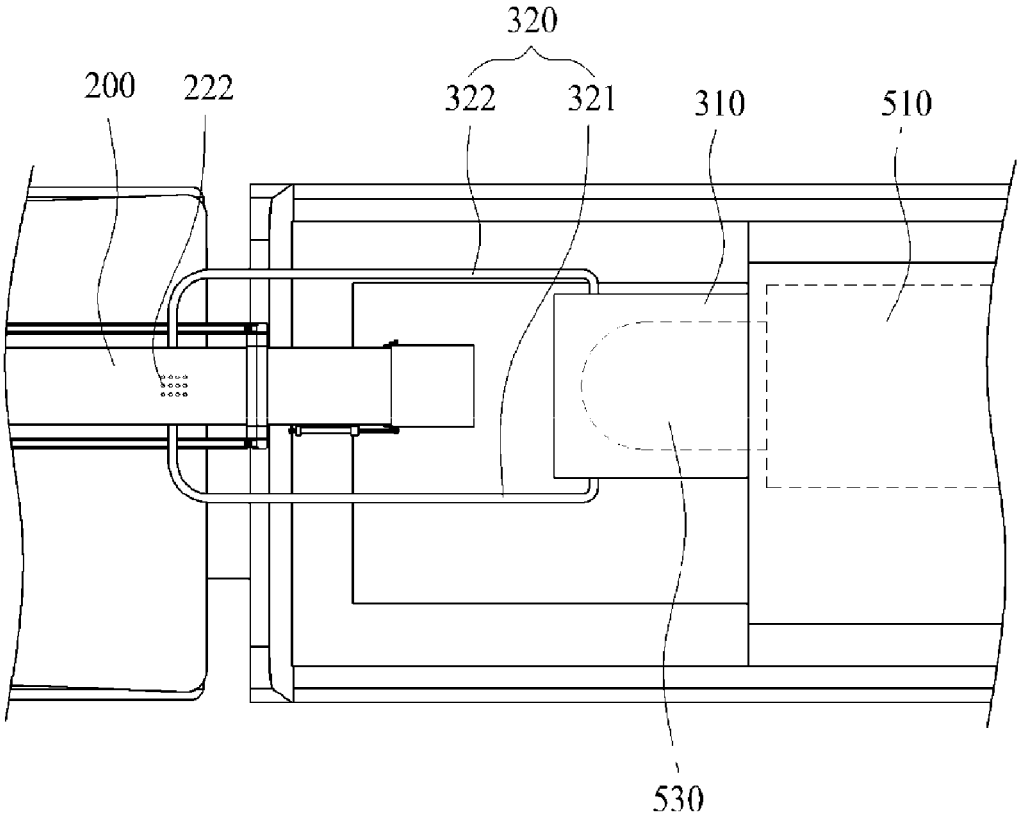
FIG. 5 is a plan view showing the configuration of the hot air induction unit of FIG. 4.
Figure 8:
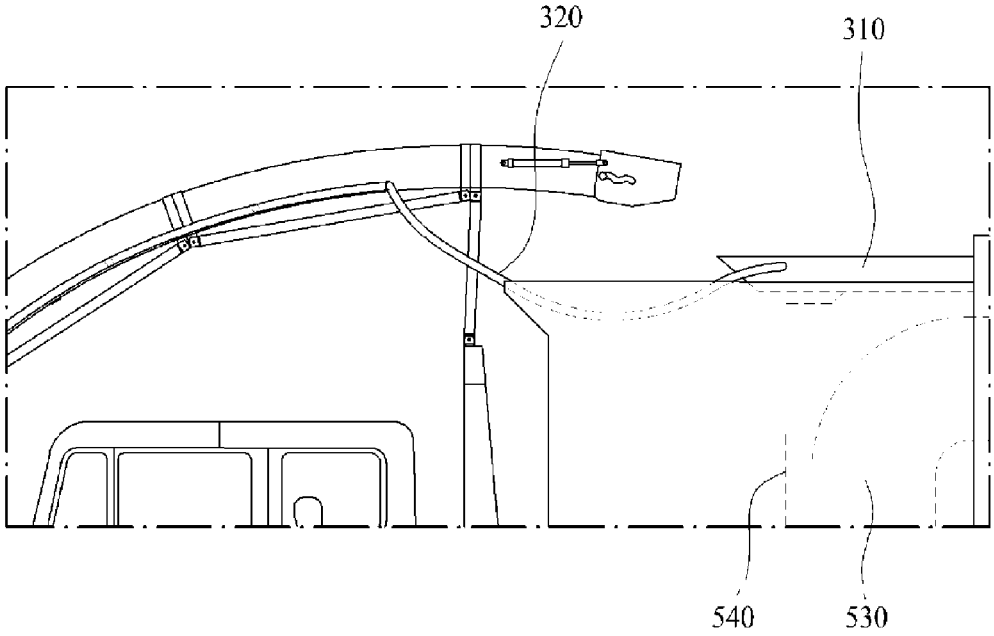
FIG. 8 is a side view showing that a configuration in which a hot air receiving chamber of FIG. 4 is provided at a plurality of locations.
Figure 9:
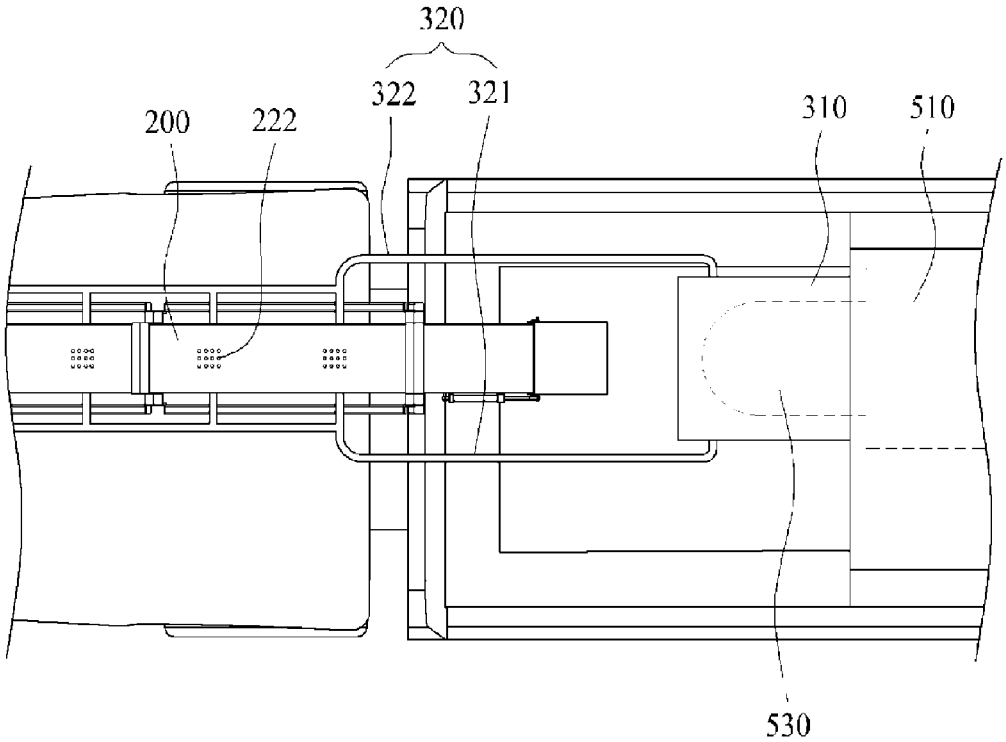
FIG. 9 is a plan view showing that the configuration in which the hot air receiving chamber of FIG. 8 is provided at a plurality of the locations.

FIG. 8 is a side view showing that a configuration in which a hot air receiving chamber 210 of FIG. 4 is provided at a plurality of locations. FIG. 9 is a plan view showing that the configuration in which the hot air receiving chamber 210 of FIG. 8 is provided at a plurality of the locations.

Since the heat through the hot air receiving chamber 210 formed in the transfer pipe 200 is transferred to only the vicinity of the hot air receiving chamber 210, it is difficult to transfer the heat to the entire transfer pipe 200. Therefore, as shown in FIG. 8, a plurality of the hot air receiving chambers 210 are provided within the transfer pipe 200, so that the heat is uniformly transferred to the transfer pipe 200.

Here, a plurality of the hot air receiving chambers 210 include the hot air induction tube 320 respectively. The hot air induction tubes 320 are connected with each other.

Through such a configuration, the hot air generated from the melter 500 is transferred to a plurality of the hot air receiving chambers 210 through both the hot air guide 310 and the hot air induction tube 320. Here, a plurality of the hot air receiving chambers 210 transfer the heat to the vicinity of the snow thrower 220, so that the snow thrower 220 can be prevented from being frozen.

The configuration of the hot air induction tube 320 will be described with reference to FIG. 9. The first hot air induction tube 321 and the second hot air induction tube 322 are connected to the both sides of the transfer pipe 200. Then, the hot air is transferred to the hot air receiving chamber 210 through the respective hot air induction tubes 320.

A process of melting the snow through the configuration of the embodiment will be described as follows.

The snow inhaled through the snowblower 100 is transferred along the transfer pipe 200 connected to the snowblower 100, and the heat is transferred to the snow which is first transferred in the transfer pipe 200. Here, the hot air receiving chamber 210 located within the transfer pipe 200 receives the hot air through the hot air guide 310. The hot air receiving chamber 210 transfers the received heat to the snow which is transferred along the snow thrower 220.

Next, when the snow is thrown from the transfer pipe 200 to the receiver 400, the hot air sprayed through the auxiliary nozzle 542 formed in the hot air collection jacket 540 transfers the heat to the snow which is secondly accumulated. The snow thrown from the transfer pipe 200 is received in the receiver 400, and the snow accumulated in the receiver 400 receives the heat from the melter 500

In this manner, the accumulated snow receives the heat and is effectively melted through this process.

Until now, an exemplary embodiment of the present invention has been and described. The embodiments can be variously modified without departing from the spirit and scope of the present invention. Therefore, the embodiment should not be limited to a particular mode and should be construed as an example. Accordingly, the present invention is not limited to the above-description and is changeable within the scope of the appended claims as well as all equivalents thereto.

What is claimed is:

1. A snow melter comprising:

a snowblower for inhaling snow;

a transfer pipe including:

a snow thrower having a shape of a first elongated chamber that extends along an axial direction of the transfer pipe, the snow thrower is connected to the snowblower and configured to transfer snow therethrough;

at least one hot air receiving chamber having a shape of a second elongated chamber that extends in parallel to the snow thrower, the at least one hot air receiving chamber is disposed on one side of the snow thrower; and at least one separating member having a shape of an elongate bar that protrudes from an inner bottom part of the transfer pipe, the at least one separating member separates the snow thrower from the at least one hot air receiving chamber and extends along the axial direction of the transfer pipe, a height of the at least one separating member is dimensioned to allow fluid communication between the snow thrower and the at least one hot air receiving chamber;

a melting tank including a receiver and a melter, wherein the receiver is configured to receive the snow transferred through the snow thrower, and wherein the melter is connected to the receiver and is configured to melt the snow accumulated in the receiver by using hot air; and a hot air induction unit connected to the transfer pipe, the hot air induction unit is configured to collect the hot air generated by the melter and to transfer the hot air to the transfer pipe, and to thereby prevent the transfer pipe from being frozen, wherein the snow thrower comprises at least one outlet for allowing the hot air transferred from the hot air induction unit to be discharged to outside, thereby generating an air pathway, in which the hot air introduced into the at least one hot air receiving chamber is capable of flowing through the hot air receiving chamber to an upper side of the snow thrower.

2. The snow melter of claim 1, wherein the hot air induction unit comprises:

a hot air guide which is located on the melter and is configured to transfer outward the hot air through a nozzle formed therein; and a hot air induction tube which is connected to the nozzle and is configured to transfer the hot air generated by the melter to the hot air receiving chamber.

3. The snow melter of claim 2, wherein the hot air receiving chamber is connected to the hot air guide through the hot air induction tube connected to the hot air receiving chamber.

4. The snow melter of claim 3, wherein the at least one hot air induction tube is connected to the hot air receiving-chamber.

5. The snow melter of claim 1, wherein the melter comprises:

a combustion furnace for generating and transferring combustion gas;

a boiling chamber which has one end connected to the combustion furnace and has the other end located within the receiver, the boiling chamber is configured to induce the combustion gas to an inside of the receiver and to boil melted liquid introduced through an open lower portion; and a hot air collection jacket which is located to surround the boiling chamber and configured to collect the hot air generated by the boiling chamber to an upper portion thereof.

6. The snow melter of claim 5, wherein the hot air collection jacket has an upper portion of which one side is open and further comprises an auxiliary nozzle which is configured to spray the hot air generated from the boiling chamber in the direction of the path of the thrown snow.

* * * * *